US006138688A

United States Patent [19]

Lombardi, Jr.

[11] Patent Number: 6,138,688

[45] Date of Patent: Oct. 31, 2000

[54] UNITARY COSMETIC ASSEMBLY

[76] Inventor: Carl M. Lombardi, Jr., 424 W. Neck Rd., Lloyd Harbor, N.Y. 11743

[21] Appl. No.: 09/312,832

[22] Filed: May 17, 1999

[51] Int. Cl.[7] ..... A45D 33/28

[52] U.S. Cl. ..... 132/297; 132/303; 132/304

[58] Field of Search ..... 132/297, 314, 132/315, 316, 317, 318, 320, 218, 300, 303, 304; 24/11 PP, 11 S, 11 R; 206/480, 483, 477, 495; 401/34, 35

[56] References Cited

U.S. PATENT DOCUMENTS

| | | | |
|---|---|---|---|
| 539,720 | 5/1895 | Bischoff | 206/480 |
| 1,493,097 | 5/1924 | Blood | 206/480 |
| 2,598,492 | 5/1952 | Boes | 206/480 |
| 2,804,082 | 8/1957 | Dewing | 132/318 |
| 2,812,563 | 11/1957 | Barber | 24/10 R |
| 3,822,783 | 7/1974 | Mortensen | 206/480 |
| 5,178,478 | 1/1993 | Ryder | 132/315 |
| 5,715,848 | 2/1998 | Conley, Jr. | 132/297 |
| 5,909,740 | 6/1999 | Sussman | 132/318 |
| 5,913,317 | 6/1999 | Tiram | 132/316 |

*Primary Examiner*—Gene Mancene
*Assistant Examiner*—Pedro Philogene
*Attorney, Agent, or Firm*—Hopgood, Calimafde, Kalil & Judlowe

[57] ABSTRACT

A unitary assembly that clusters a mirror, a lipstick and a cosmetic pencil, making it possible to store these items as a unit in a purse so that they are readily accessible to a user. The assembly is provided with a rectangular plastic frame on whose front face is supported the mirror. Projecting from the rear of the frame are end jaws adjacent opposite sides of the frame and an intermediate jaw between the end jaws. One end jaw in conjunction with the intermediate jaw acts as a flexible clip to clamp the lipstick to the frame. The other end jaw in conjunction with the intermediate jaw acts as a flexible clip to clamp the cosmetic pencil to the frame. The end jaws also function as a handle for the mirror so that as the user holds the mirror with one hand, and looks into it she can with her other hand grasping the lipstick or the cosmetic pencil, then apply color to her lips.

5 Claims, 2 Drawing Sheets

UNITARY COSMETIC ASSEMBLY

BACKGROUND OF INVENTION

1. Field of Invention

This invention relates generally to combined cosmetic items, and more particularly to a unitary cosmetic assembly that clusters a mirror, a lipstick and a cosmetic pencil.

2. Background of Invention

The most basic cosmetics are those used to adorn a woman's lips, for while many women make little use of facial powders, rouge, and eye makeup, almost all women color their lips.

A lipstick is composed of a small stick of a lip-coloring wax enclosed in a cylindrical case. After a woman applies a lipstick coating to her lips, she usually then outlines her lips with a cosmetic pencil to more clearly define the lip contours. A cosmetic pencil is similar to a regular pencil except that its central rod which is thicker is formed by a soft cosmetic substance whose composition and color are appropriate to the intended use of the pencil.

To make use of a lipstick or a cosmetic pencil, the user must be able to observe her lips, and for this purpose a mirror is essential. A woman often has occasion to adorn her lips away from home and she therefore carries in her purse a small mirror, a lipstick and a cosmetic pencil. But since the purse is usually loaded with a powder compact, a comb, a nail file and various other items, this creates a problem when the woman wishes to adorn her lips, say when seated in an airplane or on a train.

Under these circumstances, the woman may have difficulty in extracting from her crowded purse the particular items she needs, namely a mirror, a lipstick and a cosmetic pencil. And even after rummaging through the purse she succeeds in retrieving these items, she may then have difficulty in using them. Thus while she holds the mirror in one hand and the lipstick in the other, she must find a place to lay down the cosmetic pencil so that she can later used it.

It is known in the prior art to combine a small mirror with a lipstick or other cosmetic items. Thus the Dewing U.S. Pat. No. 3,804,082 shows a small mirror clipped onto a lipstick. The Ball U.S. Pat. No. DES 96,886 illustrates a combined lipstick container.

The Ryder U.S. Pat. No. 5,178,478 shows a case combining a lipstick with a lip brush. And in the Conley Jr. U.S. Pat. No. 5,715,848 there is disclosed a portable cosmetic system in which socketed within a housing provided with a mirror are a lipstick, eye liners, brushes and powders.

SUMMARY OF INVENTION

In view of the foregoing, the main object of this invention is to provide a unitary cosmetic assembly that clusters a mirror, a lipstick and a cosmetic pencil, making it possible to store these items as a unit in a purse or other carrier so that they are readily accessible to the user.

A significant advantage of this assembly is that it provides a user with all of the items required to adorn the lips, and that it does so in such a manner that when the assembly is put to use, the items are all in the hands of the user, and no item need be placed elsewhere.

More particularly, an object of this invention is to provide an assembly of the above type which includes a standard lipstick and a standard cosmetic pencil, as well as a plastic mirror frame to which is clamped the lipstick and cosmetic pencil.

Also an object of the invention is to provide an assembly of the above type which can be mass-produced at relatively low cost.

Briefly stated, these objects are attained by a unitary assembly that clusters a mirror, a lipstick and a cosmetic pencil making it possible to store these items as a unit in a purse so that they are readily accessible to a user.

The assembly is provided with a rectangular plastic frame on whose front face is supported the mirror. Projecting from the rear of the frame are end jaws adjacent opposite sides of the frame and an intermediate jaw between the end jaws. One end jaw in conjunction with the intermediate jaw acts as a flexible clip to clamp the lipstick to the frame. The other end jaw in conjunction with the intermediate jaw acts as a flexible clip to clamp the cosmetic pencil to the frame. The end jaws also function as a handle for the mirror so that as the user holds the mirror with one hand, and looks into it she can with her other hand grasping the lipstick or the cosmetic pencil, then apply color to her lips.

BRIEF DESCRIPTION OF DRAWINGS

For a better understanding of the invention, as well as other objects and features thereof, reference is made to the accompanying drawings wherein.

DESCRIPTION OF DRAWING

Figure 2:
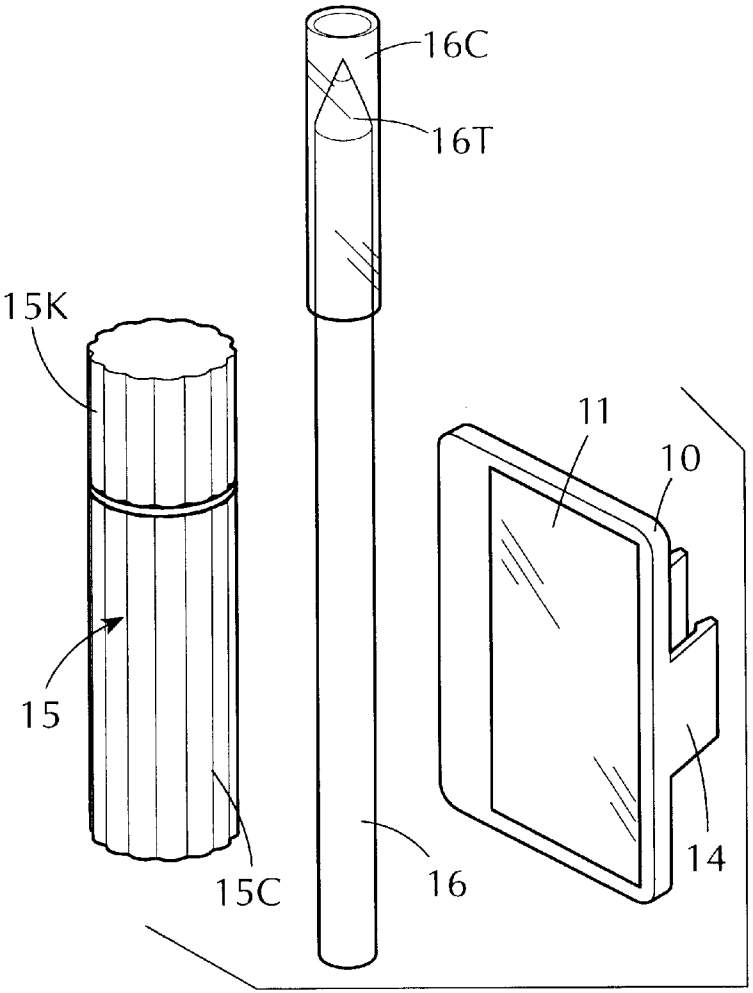
FIG. 2 separately illustrates the several components of the assembly.
Figure 1:
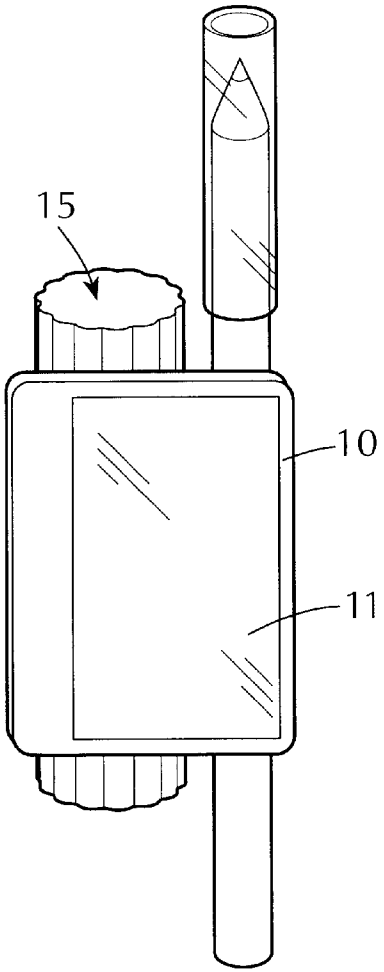
FIG. 1 is a front view of a unitary cosmetic assembly in accordance with the invention.
Figure 3:
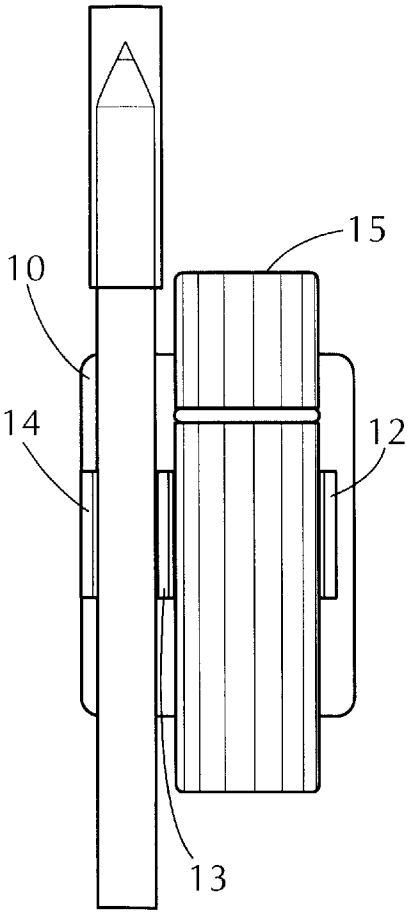
FIG. 3 is a rear view of the assembly.

Referring now to FIGS. 1, 2 and 3, it will be seen that a unitary assembly in accordance with the invention includes a rectangular frame 10 molded of synthetic plastic material, such as polystyrene, polyethylene, polypropylene, PVC or ABS. A rectangular mirror 11 is inset in a shallow well formed in the front face of the frame and is bonded thereto. The corners of the frame are rounded to avoid sharp edges.

The rectangular dimensions of the frame are preferably about 1¼ by 1¾ inches. Hence the mirror is just large enough for a user to see her lips when the mirror is brought in close proximity thereto, but not the rest of her face. In this way the user can focus on the lips while applying color thereto.

Figure 6:
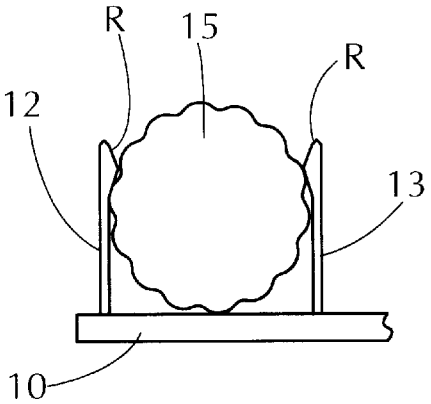
FIG. 6 illustrates the manner in which the lipstick is clamped to the frame.
Figure 7:
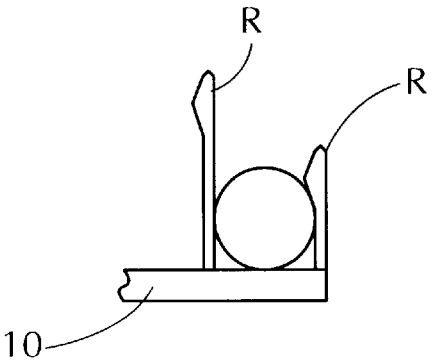
FIG. 7 illustrates the manner in which the cosmetic pencil is clamped to the frame.
Figure 4:
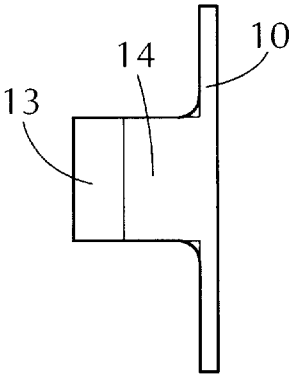
FIG. 4 is a side view of the assembly frame.
Figure 5:
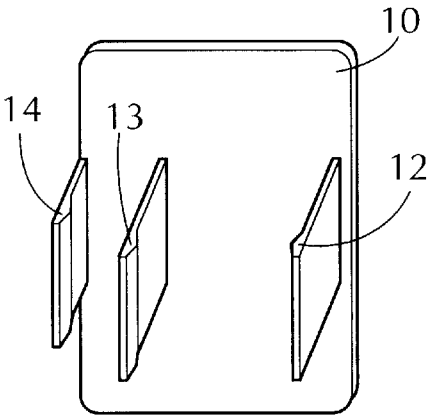
FIG. 5 is a rear view of the frame.

As best seen in FIG. 5, projecting from the rear of frame 10 and integral therewith are three resilient flat jaws 12, 13 and 14, each having on its upper edge an inwardly directed ridge R, as shown in FIGS. 6 and 7. Jaw 12 is adjacent one of the long sides of the frame, while the somewhat shorter jaw 14 is adjacent the opposite long side of the frame. Jaw 13 whose height matches that of jaw 12 projects from the rear of the frame at a position intermediate end jaws 12 and 14.

Received between end jaw 12 and intermediate jaw 13 which together function as a flexible clip is a standard lipstick 15 whose length is greater than that of the frame.

Lipstick 15 is formed by a stick of lip-coloring wax contained within a metal sleeve having a cylindrical knob 15K at its upper end. The sleeve is telescoped in a cylindrical casing 15C, as shown in FIG. 2.

When as shown in FIG. 6, lipstick 15 is received between jaws 12 and 13 which engage the casing of the lipstick, the lipstick is then clamped to the frame. To remove the lipstick from the frame, it is simply pulled out of the resilient clamping jaws.

Clamped between intermediate jaw 13 and end jaw 14, as shown in FIGS. 3 and 7, is a cosmetic pencil 16 whose tip 16T is protectively covered by a removable cap 16C of transparent plastic material, as shown in FIG. 2.

End jaws 12 and 14 at the rear of the frame serve not only as clips to clamp the cosmetic pencil and the lipstick thereto, but also as finger handles for the mirror. Ordinarily, a small framed mirror is held by fingers of the hand engaging the sides of the frame, the tips of the fingers then project in front of the mirror and to some extent may interfere with the user's ability to clearly see the image in the mirror. With the present jaw arrangement, the fingers grasping the mirror by the jaws all the rear of the frame are behind the mirror so that the mirror is unobstructed.

In operation, as the user grasps the handle of the mirror with one hand, while holding a cosmetic pencil or lipstick in the other hand, she can without difficulty apply color to her lips as she observes them in the mirror.

While there has been shown and described a preferred embodiment of a unitary cosmetic assembly in accordance with the invention, it will be appreciated that many changes may be made thereon without departing from the spirit of the invention.

I claim:

1. A unitary cosmetic assembly which makes it possible to store in a purse those items required by for a user to color her lips, said assembly comprising:

A. a rectangular frame molded of synthetic plastic material having a front face and a rear;

B. a mirror supported on said face;

C. means to clamp a cosmetic pencil onto the rear of the frame; and

D. means to clamp a lipstick onto the rear of the frame adjacent the pencil; said means to clamp the pencil and said means to clamp the lipstick being formed by three resilient jaws having flat faces in parallel relation projecting from the rear of the frame, the first and second jaws being adjacent opposing sides of the frame, the third jaw being intermediate the first and second jaws, whereby the lipstick is clampable between the flat faces of the first jaw and the third jaw and the pencil is clampable between the flat faces of the third jaw and the second jaw, the first jaw and the second jaw functioning as finger handles for the mirror.

2. An assembly as set forth in claim 1, in which the mirror is inset in a shallow well formed in the front face of the frame and is bonded thereto.

3. A. An assembly as set forth in claim 1, in which the plastic is formed of a thermoplastic material.

4. An assembly as set forth in claim 1, in which the jaws are flat and are integral with the frame.

5. An assembly as set forth in claim 4, in which each jaw has an inwardly-directed ridge at its upper edge.

* * * * *